US009734774B2

(12) United States Patent
Kurosawa

(10) Patent No.: US 9,734,774 B2
(45) Date of Patent: Aug. 15, 2017

(54) IMAGE SIGNAL GENERATING APPARATUS, LIQUID CRYSTAL DISPLAY APPARATUS, METHOD OF GENERATING IMAGE SIGNAL AND STORAGE MEDIUM STORING IMAGE SIGNAL GENERATING PROGRAM

(71) Applicant: CANON KABUSHIKI KAISHA, Tokyo (JP)

(72) Inventor: Teppei Kurosawa, London (GB)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/970,689

(22) Filed: Dec. 16, 2015

(65) Prior Publication Data

US 2016/0180794 A1 Jun. 23, 2016

(30) Foreign Application Priority Data

Dec. 19, 2014 (JP) ..... 2014-257174

(51) Int. Cl.
*G09G 3/36* (2006.01)
*G09G 3/00* (2006.01)

(52) U.S. Cl.
CPC ..... *G09G 3/3607* (2013.01); *G09G 3/002* (2013.01); *G09G 2310/0232* (2013.01); *G09G 2320/0233* (2013.01); *G09G 2320/0257* (2013.01); *G09G 2320/0261* (2013.01); *G09G 2320/0686* (2013.01); *G09G 2320/0693* (2013.01); *G09G 2320/106* (2013.01); *G09G 2360/16* (2013.01)

(58) Field of Classification Search
CPC .. G09G 3/36; G09G 5/00; G09G 5/02; G09G 5/10; G06F 3/038; G06K 9/00
See application file for complete search history.

(56) References Cited

U.S. PATENT DOCUMENTS 8,823,617 B2 9/2014 Kurosawa
2003/0156121 A1* 8/2003 Willis ..... G09G 3/3611 345/606

(Continued)

FOREIGN PATENT DOCUMENTS

JP 2012203052 A 10/2012

OTHER PUBLICATIONS

Combined Search and Examination Report issued in GB Appln. No. 1522134.4 mailed May 18, 2016.

*Primary Examiner* — Pegeman Karimi
(74) *Attorney, Agent, or Firm* — Rossi, Kimms & McDowell LLP

(57) ABSTRACT

The image signal generating apparatus for a liquid crystal display element. A corner detector detects, when an input image signal contains multiple frame images each of which includes a first image area having a first tone and including a corner portion and a second image area having a second tone higher than the first tone and being adjacent in vertical, horizontal and oblique directions to the corner portion, the corner portion in each frame image, a tone provider generates an output image signal by providing a third tone lower than the second tone to one specific pixel adjacent in the oblique direction to a vertex of the corner portion in at least one of the multiple frame images. The tone provider provides the third tone to the specific pixel when the input image signal is a moving image signal.

13 Claims, 10 Drawing Sheets

(56) References Cited

U.S. PATENT DOCUMENTS

| | | | | |
|---|---|---|---|---|
| 2004/0150654 | A1* | 8/2004 | Willis | G09G 5/10 345/602 |
| 2008/0018630 | A1* | 1/2008 | Fujino | G09G 3/3648 345/205 |
| 2011/0057961 | A1* | 3/2011 | Tsuru | G09G 3/342 345/690 |
| 2012/0242717 | A1* | 9/2012 | Kurosawa | G09G 3/001 345/690 |
| 2013/0194313 | A1 | 8/2013 | Yang et al. | |

* cited by examiner

IMAGE SIGNAL GENERATING APPARATUS, LIQUID CRYSTAL DISPLAY APPARATUS, METHOD OF GENERATING IMAGE SIGNAL AND STORAGE MEDIUM STORING IMAGE SIGNAL GENERATING PROGRAM

BACKGROUND OF THE INVENTION

Field of the Invention

The present invention relates to a technique of generating an image signal for image display by a liquid crystal display element.

Description of the Related Art

Liquid crystal display elements are used for many display apparatuses, such as direct-view monitors and liquid crystal projectors, each displaying images. FIG. 12 illustrates a schematic configuration of a liquid crystal display element. Between a common electrode 1201 and each of multiple pixel electrodes 1202, a liquid crystal containing a liquid crystal molecule 1203 is disposed. A voltage to be applied to each pixel electrode 1202 (that is, a potential difference between the common electrode 1201 and each pixel electrodes 1202) is changed depending on a tone of the image signal. Changing the applied voltage enables controlling a direction of the liquid crystal molecule 1203, which enables controlling a light amount (i.e., a display tone) of light exiting from the pixel containing the liquid crystal molecule 1203. Controlling the direction of the liquid crystal molecule 1203 of each of multiple pixels of the liquid crystal display element enables displaying an image.

The direction of the liquid crystal molecule 1203 is defined by a polar angle θ and an azimuth angle Φ in a spherical coordinate system illustrated in FIG. 12. The polar angle θ is changeable depending on the potential difference (absolute value) between the common electrode 1201 and the pixel electrode 1202. In the liquid crystal display element being in a so-called normally black mode, an increase in the potential difference increases the polar angle θ and heightens the display tone.

On the other hand, in the normally black mode, the azimuth angle Φ becomes a specific angle (pre-tilt azimuth) due to a weak alignment-regulating force caused by an alignment film formed on surfaces of the common electrode 1201 and the pixel electrode 1202.

However, the liquid crystal display element has commonly known problems, namely, unevenness in alignment of the liquid crystal molecules, which is so-called disclination, and a decrease in image quality due to the disclination. FIG. 9 illustrates an example of generation of the disclination. When an image containing a white background and a black line 201 extending vertically is displayed as illustrated in FIG. 9, a dark line (disclination line) 202 due to the disclination, which is caused by a difference in a potential (driving voltage) between mutually adjacent pixels, is generated in pixels adjacent to the right of the pixels of the black line 201. With reference to FIG. 10A, description will be made of the directions of liquid crystal molecules of a pixel 200 in which the disclination is generated.

In FIG. 10A, multiple liquid crystal molecules 204 contained in the pixel 200 in which the disclination is generated have a pre-tilt azimuth set by the alignment film formed on the surface of the electrode such that the molecules 204 are oriented in a pre-tilt direction 206 expressed by a line connecting an upper left part and a lower right part of the drawing. In addition, the polar angle of each liquid crystal molecule 204 that is an angle formed with respect to a normal of a plane of the drawing changes depending on the driving voltage, which provides tones from black to white. The drawing illustrates an example of a negative liquid crystal whose liquid crystal molecules 204 are oriented in a direction vertical to the plane of the drawing in a state in which the driving voltage is not applied and are oriented in a direction parallel to the plane of the drawing (and in the pre-tilt direction 206) in a state in which the driving voltage is applied.

Multiple liquid crystal molecules 205 located in an area in the pixel 200 adjacent to the pixel (black voltage applied pixel) displaying the black line 201 in FIG. 9 are affected by the potential difference from the black voltage applied pixel and thus are oriented in an direction 207 different from the pre-tilt direction 206 (that is, a direction parallel to a vertical side of the pixel 200). Consequently, as illustrated in FIG. 9, the disclination line 202 is generated in the pixel 200.

Japanese Patent Laid-Open No. 2012-203052 discloses an image processing method of decreasing a difference in a tone level of a target pixel from that of an adjacent pixel in order to suppress the generation of the disclination in the target pixel.

In addition, a condition of the generation of the disclination depends not only on a magnitude of the potential difference of the target pixel from the adjacent pixel, but also on a relation between a direction of a gradient of the potential difference and the pre-tilt azimuth. A pixel 203 illustrated in FIG. 9 is a pixel whose sign of the gradient of the potential difference with respect to the pre-tilt direction 206 is inverse to that of the pixel 200. In the above-described pixel 203, as illustrated in FIG. 10B, though a direction 209 of liquid crystal molecules 208 slightly changes with respect to the pre-tilt direction 206 illustrated in FIG. 10A due to an influence of the potential difference of the pixel 203 from the adjacent pixel, the direction 209 does not become parallel to the vertical side of the pixel 203. For this reason, the disclination is not generated in the pixel 203.

Furthermore, displaying on the liquid crystal display element a moving image whose sequential frame images are images in which the disclination is generated results in unevenness in image quality that is so-called a tailing. FIG. 11 illustrates a state in which a tailing 213 is generated in a moving image (between multiple frame images) containing a white background and a black rectangle. At a right side and a lower side of the black rectangle, disclination lines 211 and 212 are generated. When the black rectangle moves in a direction in which the disclination remain, a temporal residue of the disclination in its reducing process seems like a tail. In particular, when, as indicated by a white-filled arrow in the drawing, a movement direction of the black rectangle is an oblique direction opposite to a convex direction of a white-background side corner portion of the black rectangle (that is, an upper left oblique direction in the drawing), the tailing 213 appears.

The method disclosed in Japanese Patent Laid-Open No. 2012-203052 enables suppressing the generation of the disclination, thereby suppressing the generation of the tailing due to the disclination. However, use of the method disclosed in Japanese Patent Laid-Open No. 2012-203052 is likely to decrease a brightness and a contrast of a displayed image.

SUMMARY OF THE INVENTION

The present invention provides an image signal generating apparatus, a liquid crystal display apparatus and others each capable of reducing generation of a tailing without decreasing a brightness and a contrast of a displayed image.

The present invention provides as an aspect thereof an image signal generating apparatus configured to generate, from an input image signal, an output image signal for image display by a liquid crystal display element. The apparatus includes a corner detector configured to detect, when the input image signal contains multiple frame images each of which includes a first image area having a first tone and including a corner portion and a second image area having a second tone higher than the first tone and being adjacent in vertical, horizontal and oblique directions to the corner portion, the corner portion in each frame image, a tone provider configured to generate the output image signal by providing a third tone lower than the second tone to one specific pixel adjacent in the oblique direction to a vertex of the corner portion in at least one of the multiple frame images, and a determiner configured to determine whether the input image signal is a moving image signal or a still image signal. The tone provider is configured to provide the third tone to the specific pixel when the input image signal is determined to be the moving image signal.

The present invention provides as another aspect thereof an image signal generating apparatus configured to generate, from an input image signal, an output image signal for image display by a liquid crystal display element. The apparatus includes a corner detector configured to detect, when the input image signal contains multiple frame images each of which includes a first image area having a first tone and including a corner portion and a second image area having a second tone higher than the first tone and being adjacent in vertical, horizontal and oblique directions to the corner portion, the corner portion in each frame image, and a tone provider configured to generate the output image signal by providing a third tone lower than the second tone to one specific pixel included in a third image area in at least one of the multiple frame images, the third image area being a rectangular area that includes at least three pixels in both the vertical and horizontal directions, a vertex pixel adjacent in the oblique direction to a vertex of the corner portion and other pixels than the vertex pixel which are not adjacent to the first image area.

The present invention provides as still another aspect thereof an image signal generating apparatus configured to generate an image signal for image display by a liquid crystal display element. The liquid crystal display element has a characteristic that, when displaying multiple frame images which are contained in the image signal and each of which includes a first image area having a first tone and including a corner portion and a second image area having a second tone higher than the first tone and being adjacent in vertical, horizontal and oblique directions to the corner portion, and between a previous frame image and a subsequent frame image among the multiple frame images, a direction of a motion of the corner portion, which is other than the vertical and horizontal directions, is opposite to a convex direction of the corner portion in the previous frame image, in each of first liquid crystal pixels adjacent in vertical and horizontal directions to the corner portion, disclination in which directions of liquid crystal molecules become a specific direction is generated, and in one second liquid crystal pixel adjacent in an oblique direction to a vertex of the corner portion, a state occurs in which directions of liquid crystal molecules are unfixed. The apparatus includes a tone provider configured to generate the image signal by providing a third tone lower than the second tone to a pixel that is included in at least one of the multiple frame images and corresponds to the second liquid crystal pixel, and an image outputter configured to output the generated image signal.

The present invention provides as yet another aspect thereof a liquid crystal display apparatus including a liquid crystal display element, any one of the above image signal generating apparatuses, and a driver configured to drive the liquid crystal display element depending on an output image signal generated by the image signal generating apparatus.

The present invention provides as yet still another aspect thereof a method of generating, from an input image signal, an output image signal for image display by a liquid crystal display element. The method includes detecting, when the input image signal contains multiple frame images each of which includes a first image area having a first tone and including a corner portion and a second image area having a second tone higher than the first tone and being adjacent in vertical, horizontal and oblique directions to the corner portion, the corner portion in each frame image, generating the output image signal by providing a third tone lower than the second tone to one specific pixel adjacent in the oblique direction to a vertex of the corner portion in at least one of the multiple frame images, and determining whether the input image signal is a moving image signal or a still image signal. The method provides the third tone to the specific pixel when determining that the input image signal is the moving image signal.

The present invention provides as further another aspect thereof a method of generating, from an input image signal, an output image signal for image display by a liquid crystal display element. The method includes detecting, when the input image signal contains multiple frame images each of which includes a first image area having a first tone and including a corner portion and a second image area having a second tone higher than the first tone and being adjacent in vertical, horizontal and oblique directions to the corner portion, the corner portion in each frame image, and generating the output image signal by providing a third tone lower than the second tone to one specific pixel included in a third image area in at least one of the multiple frame images, the third image area being a rectangular area that includes at least three pixels in both the vertical and horizontal directions, a vertex pixel adjacent in the oblique direction to a vertex of the corner portion and other pixels than the vertex pixel which are not adjacent to the first image area.

The present invention provides as yet further another aspect thereof a method of generating an image signal for image display by a liquid crystal display element. The liquid crystal display element has a characteristic that, when displaying multiple frame images which are contained in the image signal and each of which includes a first image area having a first tone and including a corner portion and a second image area having a second tone higher than the first tone and being adjacent in vertical, horizontal and oblique directions to the corner portion, and between a previous frame image and a subsequent frame image among the multiple frame images, a direction of a motion of the corner portion, which is other than the vertical and horizontal directions, is opposite to a convex direction of the corner portion in the previous frame image, in each of first liquid crystal pixels adjacent in vertical and horizontal directions to the corner portion, disclination in which directions of liquid crystal molecules become a specific direction is generated, and in one second liquid crystal pixel adjacent in an oblique direction to a vertex of the corner portion, a state occurs in which directions of liquid crystal molecules are unfixed. The method includes generating the image signal by providing a third tone lower than the second tone to a pixel that is included in at least one of the multiple frame images and corresponds to the second liquid crystal pixel, and outputting the generated image signal.

The present invention provides as still further another aspect thereof a non-transitory computer-readable storage medium storing a computer program to cause a computer to perform any one of the above methods.

Further features and aspects of the present invention will become apparent from the following description of exemplary embodiments with reference to the attached drawings.

DESCRIPTION OF THE EMBODIMENTS

Exemplary embodiments of the present invention will be described below with reference to the attached drawings.

Embodiment 1

In order to reduce the above-described disclination, conventional methods perform image correction such as decreasing of a difference in tone level between mutually adjacent pixels, decreasing of a brightness of a displayed image and increasing of a black level in the displayed image, thereby reducing generation of the above-described tailing. However, these methods undesirably decrease the brightness and the contrast of the displayed image. For this reason, the inventor has elucidated a generating mechanism of the tailing by discovering characteristic patterns of directions of liquid crystal molecules in both a pixel in which the tailing is generated and its surrounding pixels. Embodiments hereinafter described enable reducing, without decreasing the brightness and the contrast of the displayed image, the generation of the tailing by a simple method that sets, on a basis of this generating mechanism, a pixel located in an image area in which the tailing is generated as a dark point (in other words, a black display pixel).

Figure 1:
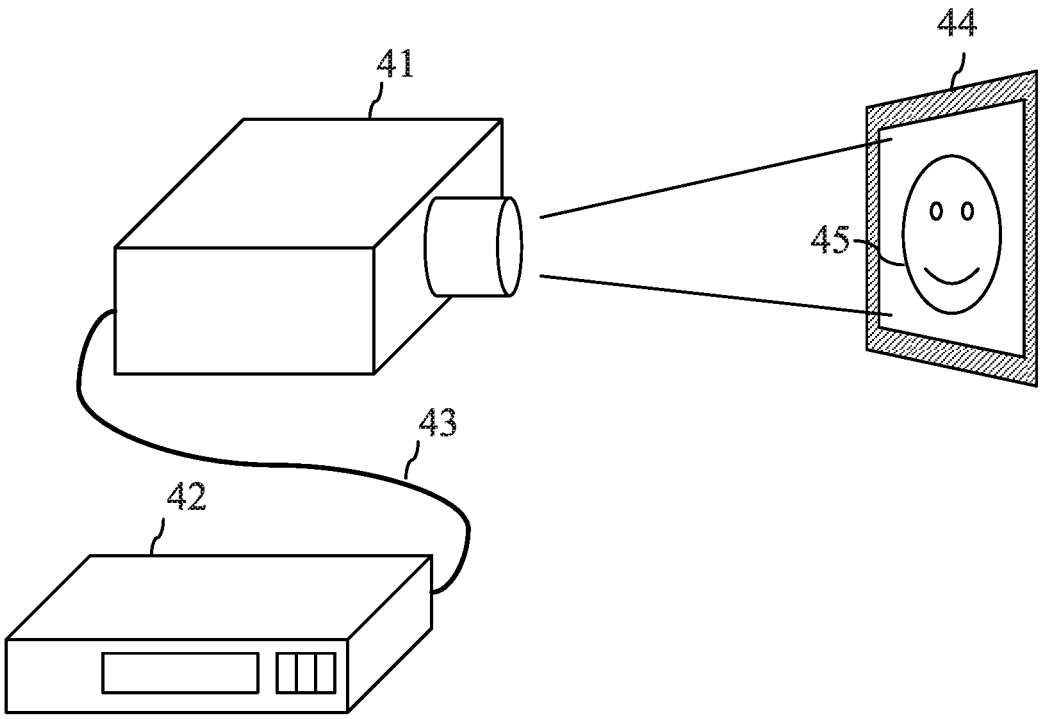
FIG. 1 illustrates a liquid crystal projector that is Embodiment 1 of the present invention.

FIG. 1 illustrates a liquid crystal projector 41 as a liquid crystal display apparatus that is a first embodiment (Embodiment 1) of the present invention. Although this embodiment and a subsequent embodiment will describe a liquid crystal projector as an example of a display apparatus using a liquid crystal display element, a method of suppressing the generation of the tailing (method of generating an image signal) can be applied also to other display apparatuses each using the liquid crystal display element such as a direct-view monitor.

An image signal (external image signal) output from a video player 42 is input to the liquid crystal projector 41 via a video cable 43. The liquid crystal projector 41 generates, from the external input image signal, an output image signal suitable for use in display and projects an image (projected image) 45 corresponding to the output image signal onto a projection surface 44 such as a screen.

Figure 2:
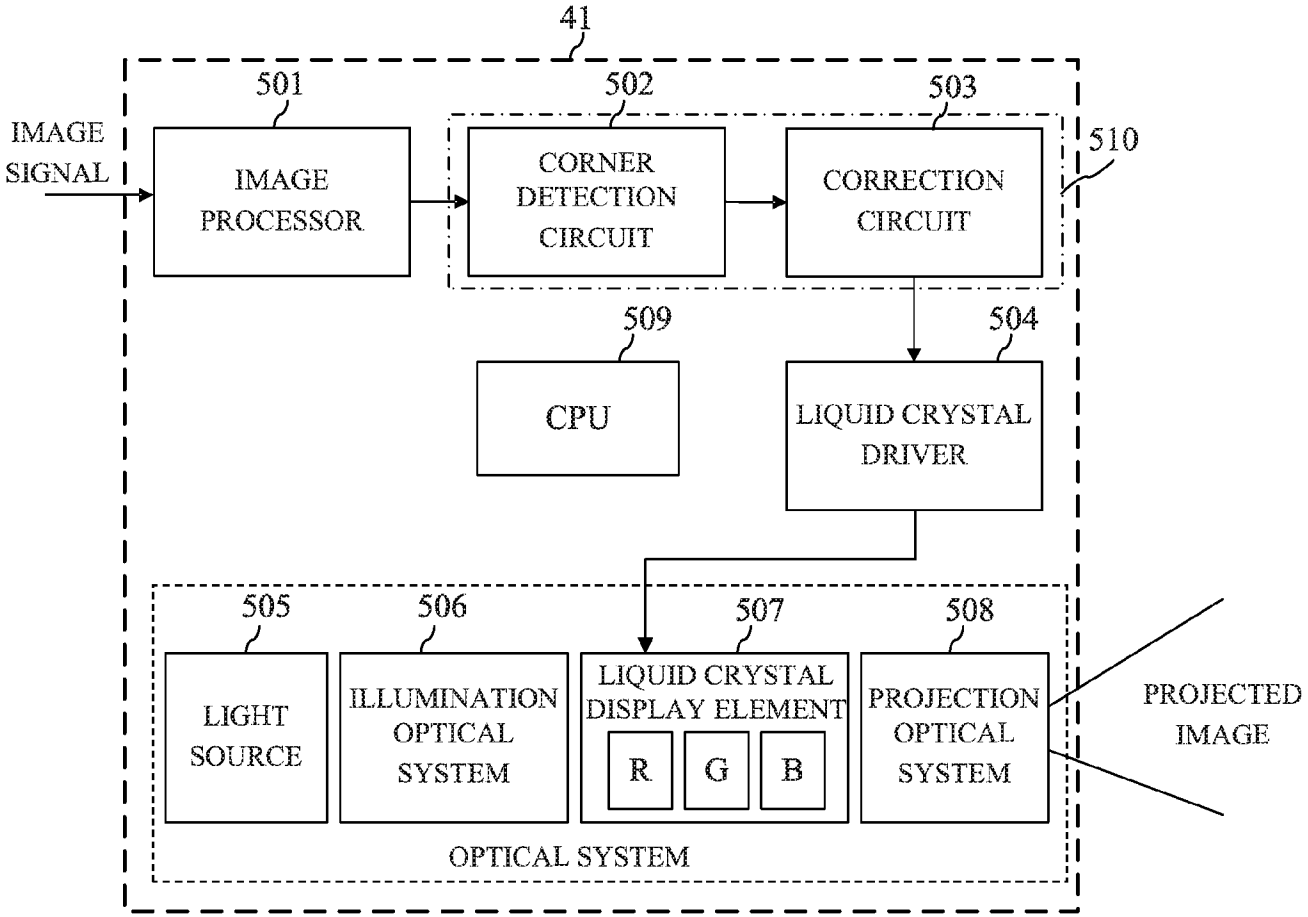
FIG. 2 is a block diagram illustrating a configuration of the liquid crystal projector.

FIG. 2 illustrates a configuration of the liquid crystal projector 41. The external image signal input to the liquid crystal projector 41 is subjected by an image processor 501 to various image processes such as a brightness correction process, a contrast correction process, a gamma conversion process and a color conversion process. The image signal subjected to the image processes is input to an image signal generator 510 as an image signal generating apparatus.

The image signal generator 510 is constituted by a computer, such as a MPU or a CPU, which dedicatedly performs processes on the input image signal. The image signal generator 510 generates, from the input image signal that is the image signal subjected to the above-described image processes, the output image signal subjected to a correction process for suppressing the generation of the tailing and outputs the output image signal to a liquid crystal driver 504. The image signal generator 510 is constituted by a corner detection circuit (as a corner detector) 502 and a correction circuit (as a tone provider and an image outputter) 503. Specific processes performed thereby will be described later.

The liquid crystal driver 504 converts the output image signal from the image signal generator 510 into a liquid crystal driving voltage to drive a liquid crystal display element 507. When the liquid crystal display element 507 is driven by an analog drive method, the liquid crystal driver 504 converts the output image signal from the image signal generator 510 into a voltage value depending on an output tone of the output image signal. On the other hand, when the liquid crystal display element 507 is driven by a digital drive method, the liquid crystal driver 504 generates a PWM pattern for switching ON and OFF of the drive depending on the output tone and inputs the PWM pattern to the liquid crystal display element 507.

The liquid crystal display element 507 is provided for each of red (R), green (G) and blue (B). The liquid crystal display elements 507 display R, G and B images (each being continuous frame images). Light from a light source 505 is separated by an illumination optical system 506 into three color lights, namely, an R light, a G light and a B light. The three color lights enter the three liquid crystal display elements 507 and are subjected by the liquid crystal display element 507 to image modulation. The three color lights subjected to the image modulation are combined into one light, and the combined light is projected through a projection optical system 508.

A CPU 509 as a main controller controls the processes performed by the image processor 501 and the image signal generator 510 and controls drive of the light source 505 and the drive of the liquid crystal display elements 507 by the liquid crystal driver 504.

Figure 3A:
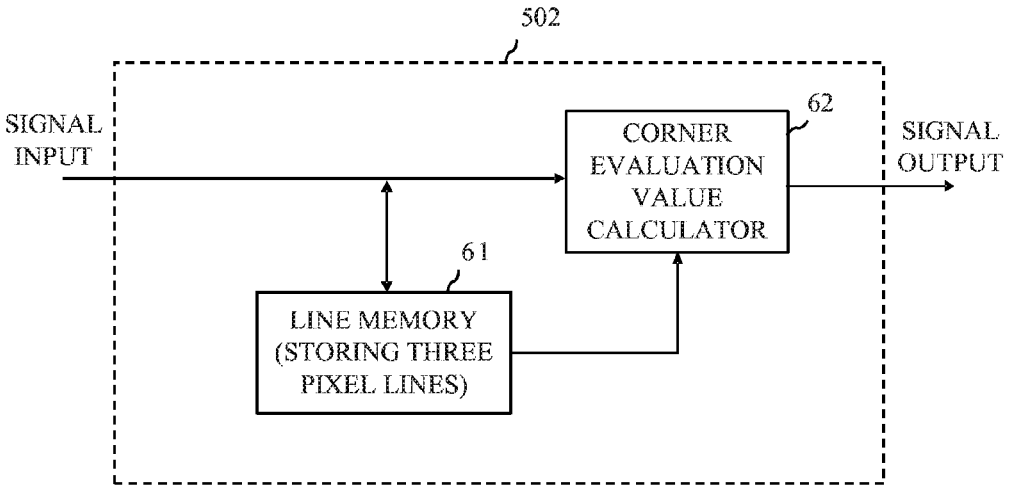
FIGS. 3A and 3B are respectively a block diagram illustrating a configuration of a corner detection circuit in Embodiment 1 and a flowchart illustrating a process performed by an image signal generator (that is, the corner detection circuit and a correction circuit) in Embodiment 1.
Figure 3B:
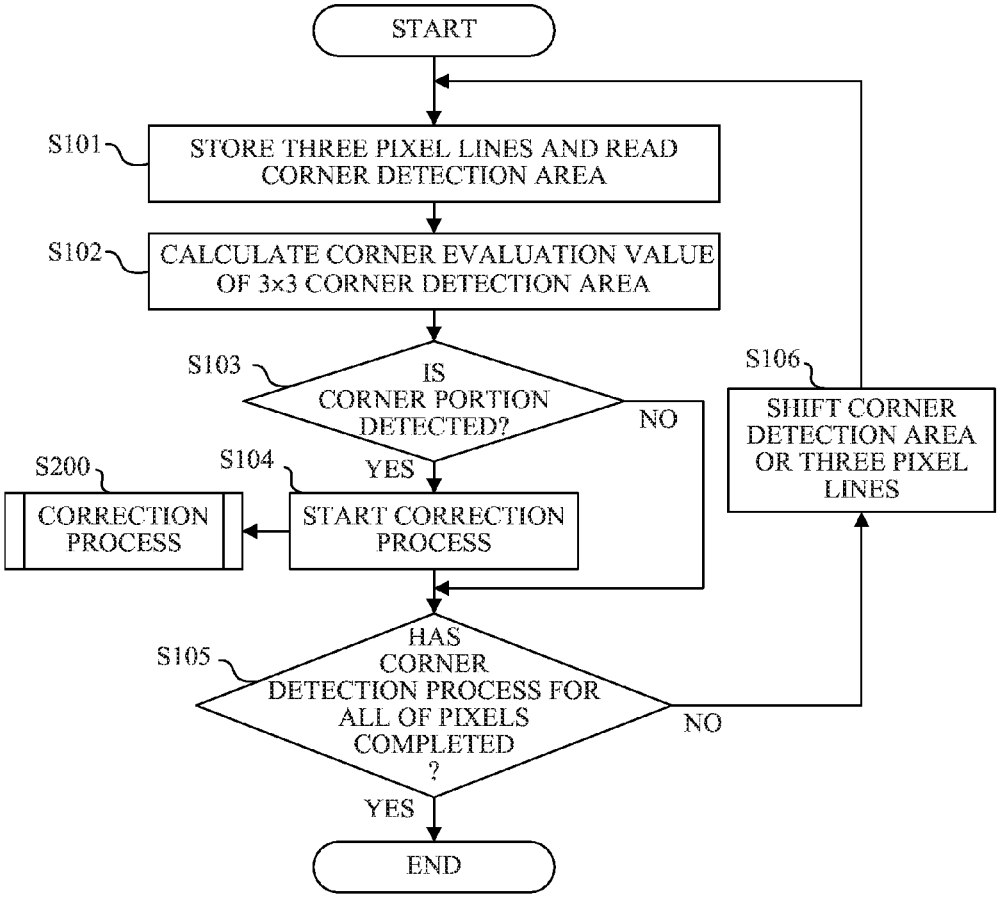

Next, with reference to FIGS. 3A, 3B, 4A and 4B, description will be made of a configuration and a process of the corner detection circuit 502 in the image signal generator 510. FIG. 3A is a block diagram illustrating a configuration of the corner detection circuit 502. FIG. 3B is a flowchart illustrating a process (image signal generating method) performed by the image signal generator 510. The image signal generator 510, which is the computer as described above, executes the process according to an image signal generating program as a computer program.

Figure 4A:
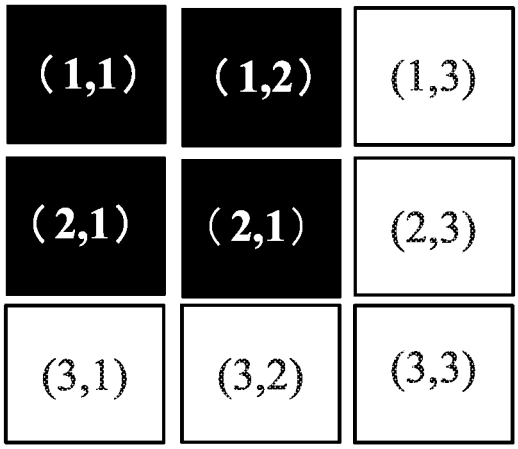
FIGS. 4A and 4B illustrate a detection operation of the corner detection circuit.

At step S101, the corner detection circuit 502 stores, to a line memory 61, tone values of three pixel lines mutually adjacent in the frame image of the input image signal. Then, as illustrated in FIG. 4A, the corner detection circuit 502 reads pixel information of a rectangular corner detection area formed by 3×3 pixels in which 3 pixels are arranged in both vertical and horizontal directions to make the pixel information ready to be analyzed. The corner detection area having the above-described 3×3 pixel size is merely an example, the corner detection area may have a size larger than the 3×3 pixel size.

At step S102, the corner evaluation value calculator 62 calculates a corner evaluation value C for the corner detection area of the 3×3 pixel (hereinafter referred to as "a 3×3 pixel corner detection area"), by using an evaluation expression expressed by following expression (1):

$$C = [255 - P(1, 1)] + [255 - P(1, 2)] + [255 - P(2, 1)] + [255 - P(2, 2)] + P(1, 3) + P(2, 3) + P(3, 1) + P(3, 2) + P(3, 3) \quad (1)$$

where P(i,j) (i,j=1 to 3) represents a tone value of each pixel (coordinates) of the 3×3 pixel corner detection area illustrated in FIG. 4A.

At step S103, the corner detection circuit 502 determines whether or not the corner evaluation value C is equal to or more than a predetermined value. When the corner evaluation value C is equal to or more than the predetermined value, the corner detection circuit 502 detects, in a frame image where a white background area (second image area) is adjacent in the vertical and horizontal directions and in an oblique (or diagonal) direction to a corner portion of a black rectangular area (first image area) as illustrated in FIG. 4A, the above corner portion. At this step, the corner detection circuit 502 detects the corner portion whose size is a 2×2 pixel size as illustrated in FIG. 4A.

Description will hereinafter be made of a case where the frame image is an image having an 8-bit tone (0 to 255 tones). As illustrated in FIG. 4A, the predetermined value that is a threshold of the corner evaluation value C is set to, for example, a value of approximately 2250 (250×9) so as to achieve an accurate detection of the corner portion of the black rectangular area adjacent to the white background area. In practice, it is desirable to optimize the predetermined value for each of the liquid crystal display elements 507 depending on its pixel pitch, its driving voltage, its use temperature, its liquid crystal material, its alignment condition and others and on a degree of the generation of the tailing. The evaluation expression may be an expression other than expression (1) that enables accurately detecting the above-described corner portion.

Figure 4B:
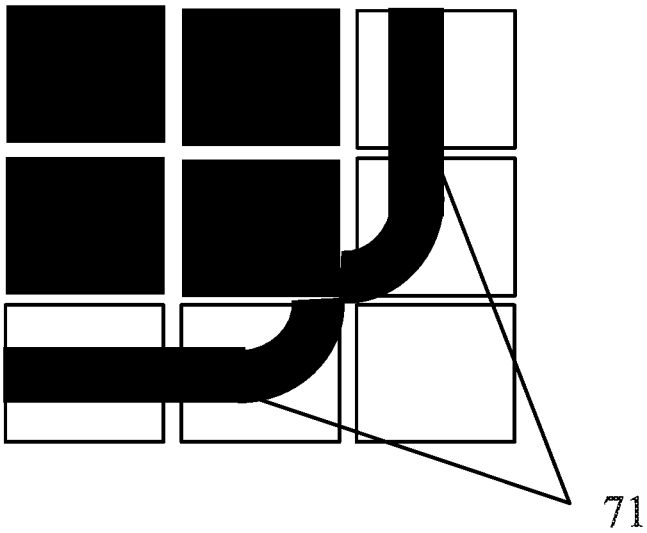

The evaluation expression expressed as expression (1) is created with an assumption that, as illustrated in FIG. 4B, disclination lines 71 are generated in white display pixels adjacent to two sides, namely, a right side and a lower side (that is, a vertical side and a horizontal side) of the corner portion of the black rectangular area in the liquid crystal display element 507. The inventor has verified that the tailing is generated according to the later-described generating mechanism, particularly when the rectangular area is moved in an upper left oblique direction in FIG. 4B between previous and subsequent frame images. For this reason, the evaluation expression expressed as expression (1) that enables accurately detecting the corner portion of the black rectangular area is used. When positions of the pixels at which the disclination is generated are different from those in FIG. 4B depending on the pre-tilt direction of the liquid crystal display element or the like, the evaluation expression may be appropriately altered.

After the detection of the corner portion, the corner detection circuit 502 causes at step S104 the correction circuit 503 to start the correction process. The correction circuit 503 performs the correction process at step S200. The corner detection circuit 502 sequentially performs the above-described corner portion detection process on the entire frame image (all of the pixels) while shifting the corner detection area and the three pixel lines to be stored in the line memory 61 (in order of step S105, step S106 and step S101).

Figure 5:
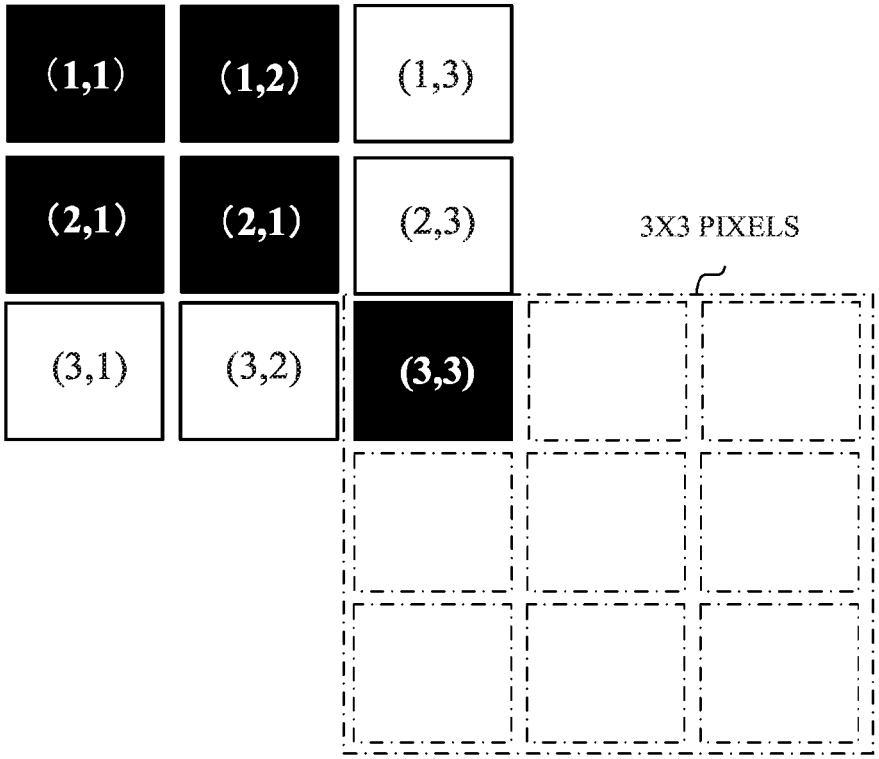
FIG. 5 illustrates an example of a corrected image subjected to a correction process by the correction circuit in Embodiment 1.

FIG. 5 illustrates the correction process performed by the correction circuit 503 on the input image signal at step S200 in FIG. 3B. The correction circuit 503 provides a black tone to one specific pixel (3,3) adjacent in the oblique direction to a vertex of the corner portion (that is, a corner-portion side vertex of the pixel (2,1)) in the frame image detected by the corner detection circuit 502.

The inventor has verified that providing, to the one specific pixel, the black tone (third tone) lower than its original white tone (second tone) as just described enables effectively suppressing the generation of the tailing. Description will hereinafter be made of the generating mechanism of the tailing on a basis of a characteristic of the liquid crystal display element and the mechanism of suppressing the generation of the tailing by providing the black tone to the specific pixel, both of which have been discovered by the inventor.

Figure 6A:
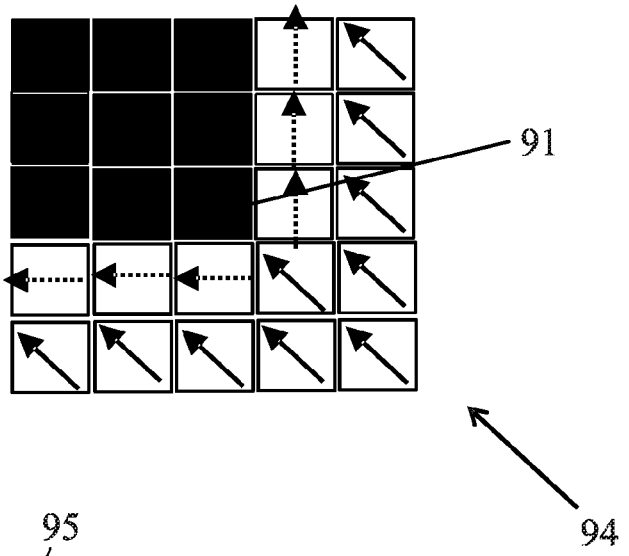
(PRIOR ART) FIG. 6A
FIGS. 6A to 6C illustrate a mechanism of generation of a tailing.
Figure 6B:
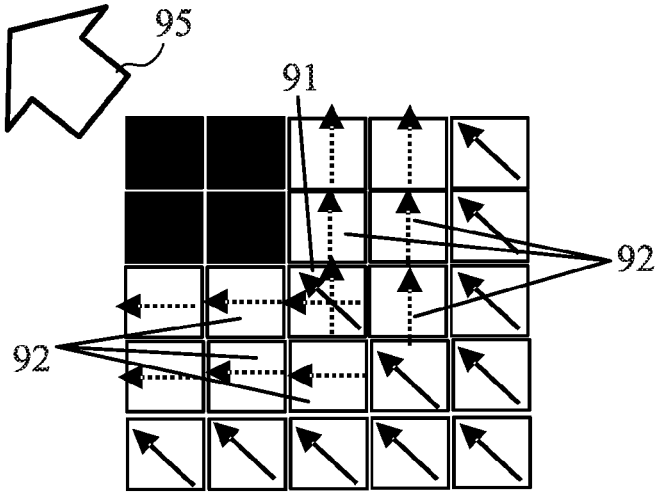
(PRIOR ART) FIG. 6B
Figure 6C:
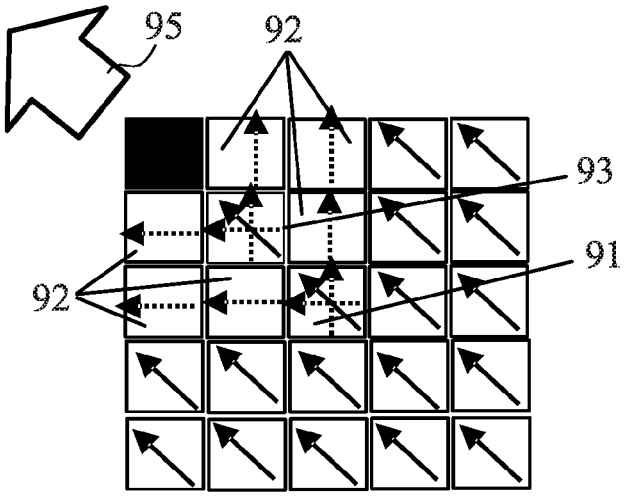
(PRIOR ART) FIG. 6C

First, with reference to FIGS. 6A to 6C, description will be made of the generating mechanism of the tailing. FIGS. 6A to 6C each illustrate 5×5 rectangular pixels (hereinafter each referred to as "a liquid crystal pixel") in the liquid crystal display element 507 on which continuous plural (three) frame images constituting part of a moving image signal are displayed. An arrow in each of the liquid crystal pixels indicates a direction of multiple liquid crystal molecules contained in that liquid crystal pixel. Each arrow shows that its bottom side is located on a lower side in a direction vertical to a plane of each of FIGS. 6A to 6C and that its arrowhead side is located on an upper side in that direction. Each of the frame images is an image in which the white background area is adjacent in the vertical, horizontal and oblique directions to the corner portion of the black rectangular area. In order of FIG. 6A, FIG. 6B and FIG. 6C, the black rectangular area including the corner portion sequentially moves one pixel by one pixel in the oblique (or diagonal) direction 95 opposite to a convex direction of the corner portion in the frame image. The oblique direction is hereinafter referred to as "an oblique movement direction".

The frame image illustrated in FIG. 6A is a previous frame image when the two frame images illustrated in FIGS. 6A and 6B are respectively regarded as previous and subsequent frame images, and the frame image illustrated in FIG. 6B is a previous frame image when the two frame images illustrated in FIGS. 6B and 6C are respectively regarded as previous and subsequent frame images.

Although FIGS. 6A to 6C illustrate, as an example, a case where the oblique movement direction 95 and the oblique direction in which the liquid crystal pixels are adjacent to one another are mutually identical, the movement direction of the corner portion may be different from the oblique movement direction 95 illustrated in FIGS. 6A to 6C as long as the movement direction is other than the vertical and horizontal directions and is opposite to the convex direction of the corner portion of the previous frame image.

In a liquid crystal pixel 91 forming a vertex of the corner portion of the black rectangular area illustrated in FIG. 6A, the direction of the liquid crystal molecules is an upward vertical direction to the plane of FIG. 6A as illustrated beside reference numeral 91. On the other hand, of the liquid crystal pixels in the white background area, six liquid crystal pixels (first liquid crystal pixels) adjacent in the horizontal direction (on a right side) and the vertical direction (on a lower side) to two sides of the black rectangular area including the corner portion are in a state where the disclination is generated. That is, as indicated by dotted arrows, the liquid crystal molecules of the six liquid crystal pixels are oriented, due to the disclination, in an direction different from a normal alignment direction (pre-tilt direction) 94 in a state (white display state) where these pixels are the white display pixels. However, the direction different from the normal alignment direction is, for the liquid crystal pixels adjacent to the right side of the black rectangular area, a direction parallel to that right side (in other words, to left sides of the liquid crystal pixels) and is, for the liquid crystal pixels adjacent to the lower side of the black rectangular area, a direction parallel to that lower side (in other words, an upper side of the liquid crystal pixels). That is, the directions of the liquid crystal molecules of the six liquid crystal pixels in which the disclination is generated (hereinafter each referred to as "a disclination pixel") are different from the normal alignment direction but are fixed in specific directions.

In the white background area, the directions of the liquid crystal molecules of the liquid crystal pixels other than the six disclination pixels, which include one liquid crystal pixel adjacent in the oblique direction to the liquid crystal pixel 91, correspond to the pre-tilt direction 94.

In FIG. 6B, with the movement of the black rectangular area, the liquid crystal pixel 91 is brought into a state in which a voltage for white display is applied (the state is hereinafter referred to as "a white voltage applied state"). In this white voltage applied state, the directions of the liquid crystal molecules of the liquid crystal pixel 91 is supposed to correspond to the pre-tilt direction 94. However, the liquid crystal pixel 91 is surrounded by a large number of (in the drawing, six) disclination pixels 92 in which the directions of the liquid crystal molecules are not uniform due to the disclination. For this reason, the liquid crystal molecules of the liquid crystal pixel 91 are oriented, by interactions with the liquid crystal molecules of the disclination pixels 92 surrounding the liquid crystal pixel 91, in directions corresponding to the directions of the liquid crystal molecules of the disclination pixels 92. Thus, the directions of the multiple liquid crystal molecules contained in the liquid crystal pixel 91 are not fixed to the pre-tilt direction 94 or another specific direction, that is, include various directions. That is, the liquid crystal pixel 91 is brought into a state where the liquid crystal molecules oriented in the various directions are mixed, which means that the liquid crystal pixel 91 is not in the white display state. In the following description, the state in which the liquid crystal molecules oriented in the various directions are mixed, that is, a state in which the directions of the liquid crystal molecules are unfixed (unaligned) is referred to also as "an unfixed liquid crystal direction state (or an unaligned state)". The unfixed liquid crystal direction state is regarded as being different from a simple disclination in which the directions of the liquid crystal molecules are not normal but are fixed (aligned).

Even when the liquid crystal pixel containing the liquid crystal molecules whose directions are unfixed (the pixel is hereinafter referred to also as "an unfixed liquid crystal direction pixel") is brought into the white voltage applied state, it requires a long period of time from approximately several hundred microseconds to several seconds for the multiple liquid crystal molecules contained in the liquid crystal pixel to be stably aligned in the pre-tilt direction 94. That is, during this period of time, that liquid crystal pixel remains as the unfixed liquid crystal direction pixel and thus does not change into the white display state.

In FIG. 6C, with a further movement of the black rectangular area, a liquid crystal pixel 93 having formed the vertex of the corner portion of the black rectangular area is also brought into the white voltage applied state. However, the movement of the black rectangular area generates new disclination pixels along the two sides of the black rectangular area and thereby the liquid crystal pixel 93 is surrounded by a large number of (six) disclination pixels 92, similarly to the liquid crystal pixel 91 in FIG. 6B. For this reason, the liquid crystal molecules of the liquid crystal pixel 93 become the unfixed liquid crystal direction state and therefore the liquid crystal pixel 93 does not change into the white display state for a long period of time.

Figure 11:
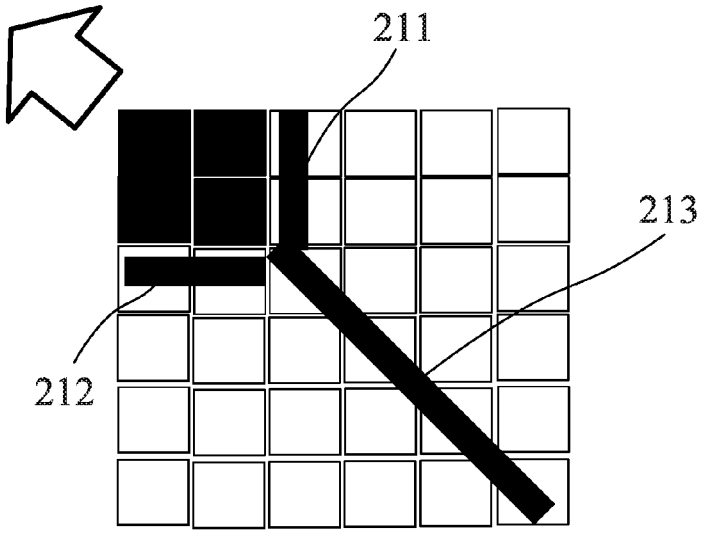
(PRIOR ART) FIG. 11
FIG. 11 illustrates the tailing.

Such sequential generation of the liquid crystal pixels (unfixed liquid crystal direction pixels) not changing into the white display state in the respective frame images generates the tailing extending long from the vertex of the corner portion of the black rectangular area in the oblique direction (as illustrated in FIG. 11).

Figure 7A:
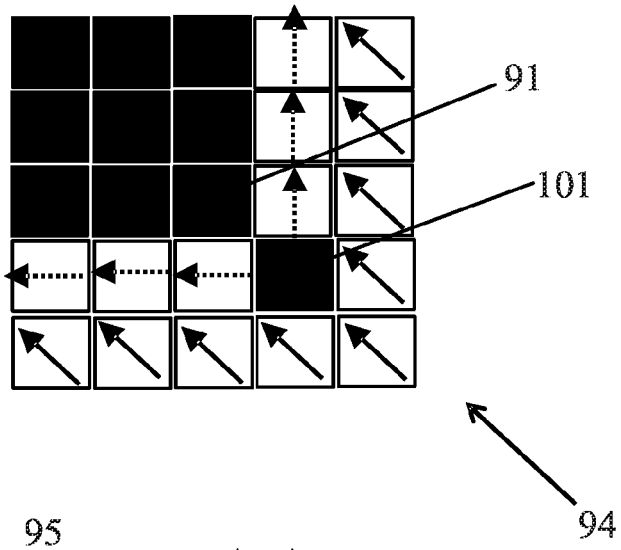
FIGS. 7A to 7C illustrate a mechanism of suppression of the tailing by Embodiment 1.
Figure 7B:
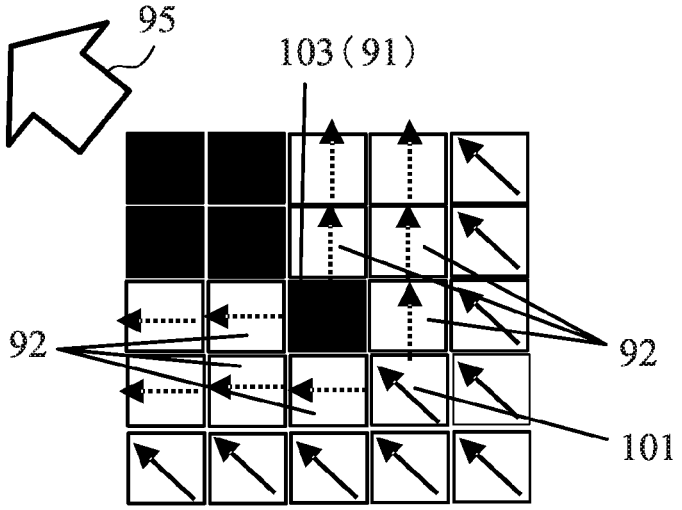
Figure 7C:
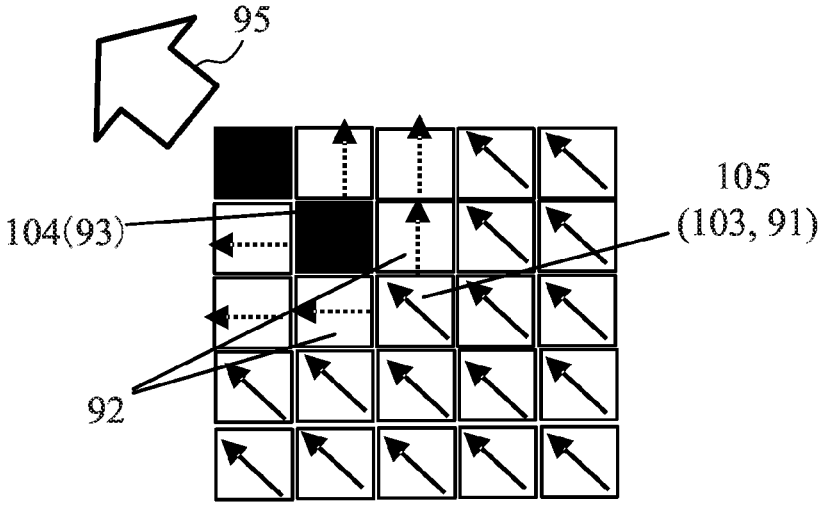

Next, with reference to FIGS. 7A to 7C, description will be made of the mechanism of suppressing the generation of the tailing. FIGS. 7A to 7C illustrate the directions of the liquid crystal molecules of the 5×5 liquid crystal pixels when the same frame images as those illustrated in FIGS. 6A to 6C to each of which the black display pixel as the specific pixel illustrated in FIG. 5 is added by the correction circuit 503 are displayed on the liquid crystal display element 507. In the following description, a liquid crystal pixel (second liquid crystal pixel) corresponding to the specific pixel in each frame image is referred to also as "a specific liquid crystal pixel".

In FIG. 7A, the specific pixel of the frame image becomes the black display pixel, and thereby a specific liquid crystal pixel 101 adjacent in the oblique direction to the vertex (liquid crystal pixel 91) of the corner portion of the black rectangular area illustrated in FIG. 6A is brought into a black display state in which a voltage for black display is applied (hereinafter referred to also as "a black voltage applied state").

In FIG. 7B in which the corner portion of the black rectangular area moves by one pixel in the oblique movement direction 95 from its position in FIG. 7A, a specific liquid crystal pixel 103 corresponding to the liquid crystal pixel 91 having been the unfixed liquid crystal direction pixel in FIG. 6B is brought into the black voltage applied state. The liquid crystal molecules of the specific liquid crystal pixel 103 brought into the black voltage applied state are oriented in an upward vertical direction to a plane of FIG. 7B. The six disclination pixels 92 having surrounded the liquid crystal pixel 91 in FIG. 6B also surround the specific liquid crystal pixel 101 in FIG. 7B.

In FIG. 7C in which the corner portion of the black rectangular area further moves by one pixel in the oblique movement direction 95 from its position in FIG. 7B, a specific liquid crystal pixel 104 corresponding to the liquid crystal pixel 93 having been the unfixed liquid crystal direction pixel in FIG. 6C is brought into the black voltage applied state (black display state). In this state, when the liquid crystal pixel 105 having been brought into the black voltage applied state as the specific liquid crystal pixel 103 in FIG. 7B is brought into the white voltage applied state, the liquid crystal molecules of the liquid crystal pixel 105 are oriented in the pre-tilt direction 94 that is the normal direction in the white display state. This is because the liquid crystal pixel 105 does not become the unfixed liquid crystal direction pixel in FIG. 7B and is adjacent to a large number of (five) liquid crystal pixels being normally in the white display state, which are other than a small number of (two) disclination pixels 92 in FIG. 7C. Consequently, the tailing is not generated.

As described above, this embodiment performs the process of providing the black tone to the one specific pixel (adjacent in the oblique direction to the corner portion of the black rectangular area in the frame image contained in the input image signal) that originally has the white tone. This process enables preventing the liquid crystal pixels from being brought into the unfixed liquid crystal direction state, which enables efficiently suppressing the generation of the tailing. In addition, this process merely displays the one specific pixel in black (in other words, darkens the one specific pixel), which enables suppressing the generation of the tailing without decreasing the brightness and the contrast of the displayed image that is displayed on the liquid crystal display element 507.

Moreover, although this embodiment described the case of detecting, by the corner detection circuit 502, the corner portion of the black rectangular area having the 2×2 pixel size, the size of the corner portion to be detected may be changed depending on the pixel pitch of the liquid crystal display element. For instance, when the pixel pitch is a half of that of the liquid crystal display element 507 in this embodiment, the corner portion having a 4×4 pixel size may be detected.

Furthermore, this embodiment regards a period of time required to eliminate the disclination (in other words, a disclination reducing time) as approximately one frame period, so that this embodiment described the case of changing, by the correction circuit 503, the one specific pixel from the white display pixel into the black display pixel in order to suppress the tailing. However, the number of the specific pixels may be increased to, for example, two or more in the oblique direction from the vertex of the corner portion, depending on the disclination reducing time that depends on a characteristic of the liquid crystal, the number of the liquid crystal pixels (resolution) and a frame rate.

For instance, this embodiment takes into consideration a case of displaying an image signal having a resolution of 8K×4K and a frame rate of 120 Hz. In this case, as indicated by dashed-dotted lines in FIG. 5, a rectangular image area (third image area) is set which includes, as a vertex pixel, one pixel (3,3) adjacent in the oblique direction to the vertex of the corner portion and includes 3×3 pixels (or a larger number of pixels) in which other pixels than the vertex pixel are not adjacent to the black rectangular area. At least any one of the pixels in the rectangular area may be the black display pixel as the specific pixel.

In addition, this embodiment described the case of setting, upon the detection of the corner portion of the black rectangular area in the frame image, the specific pixel in that frame image as the black display pixel as illustrated in FIG. 7A. However, other specific pixels in subsequent frame images (from a next frame image or from a frame image after a predetermined number of frames) may be set as the black display pixel. For example, the specific pixel included in the frame image illustrated in FIG. 7B or FIG. 7C in which the corner portion is detected may be set initially as the black display pixel. This is because when only several frame images have the corner portion, the tailing is not noticeable.

Furthermore, this embodiment described the case where the first tone is black and the second tone is white. However, the first and second tones are not necessarily to be black and white respectively, and it is only necessary that the second tone is higher than the first tone. Similarly, this embodiment described the case where the third tone provided to the specific pixel is black. However, the third tone is not necessarily required to be black, and it is only necessary that the third tone is a tone lower than the second tone.

Figure 12:
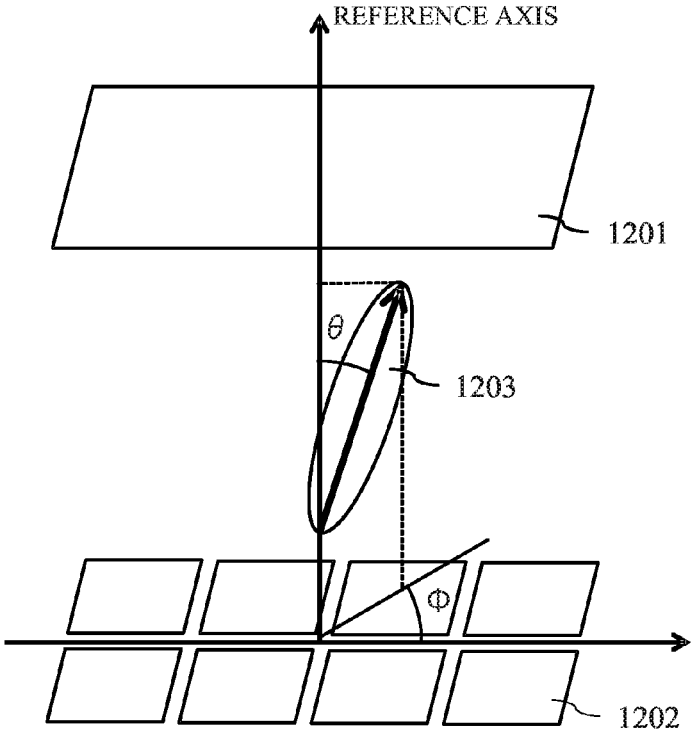
(PRIOR ART) FIG. 12
FIG. 12 illustrates a schematic configuration of a liquid crystal display element.

From this embodiment, a method of driving the liquid crystal display element with a concept described below can be derived. As illustrated in FIG. 12, the liquid crystal display element is constituted by the two electrodes (1201 and 1202) and the liquid crystal (liquid crystal molecule (1203)) disposed between the electrodes. At least one of the two electrodes is separated into multiple pixel electrodes (1202). Independent voltages depending on tone values of pixels of a displayed image to be displayed on the liquid crystal display element are applied to the liquid crystals on the pixel electrodes. In the spherical coordinate system whose reference axis is a normal to a two-dimensional surface on which the pixel electrodes are arranged, the polar angle $\theta$ of the direction of the liquid crystal (liquid crystal molecules) is controlled depending on the applied voltage. On the other hand, the azimuth angle $\Phi$ of the direction of the liquid crystal is fixed to a specific initial azimuth angle by an alignment direction controller (that is, the alignment film) formed on the two electrodes. When an absolute value of the voltage applied to the liquid crystal on a specific one of multiple pixels (pixel electrodes) is changed from a first voltage to a second voltage higher than the first voltage, the azimuth angle of the liquid crystals on at least half of the multiple pixels adjacent to and surrounding the specific pixel is the initial azimuth angle.

Embodiment 2

Next, description will be made of a second embodiment (Embodiment 2) of the present invention. In this embodiment, the image signal generator 510 illustrated in FIG. 2 extracts, from each of frame images included in an input image signal, a number of pixels constituting each of pixel groups each including mutually identical tone pixels and creates a histogram of the extracted numbers. Then, the image signal generator 510 as a determiner determines, by comparing the histograms created for a previous frame image and a subsequent (current) frame image, whether the input image signal is a moving image signal or a still image signal. The image signal generator 510 performs the correction process by the correction circuit 503 only when the input image signal is the moving image signal.

Figure 8:
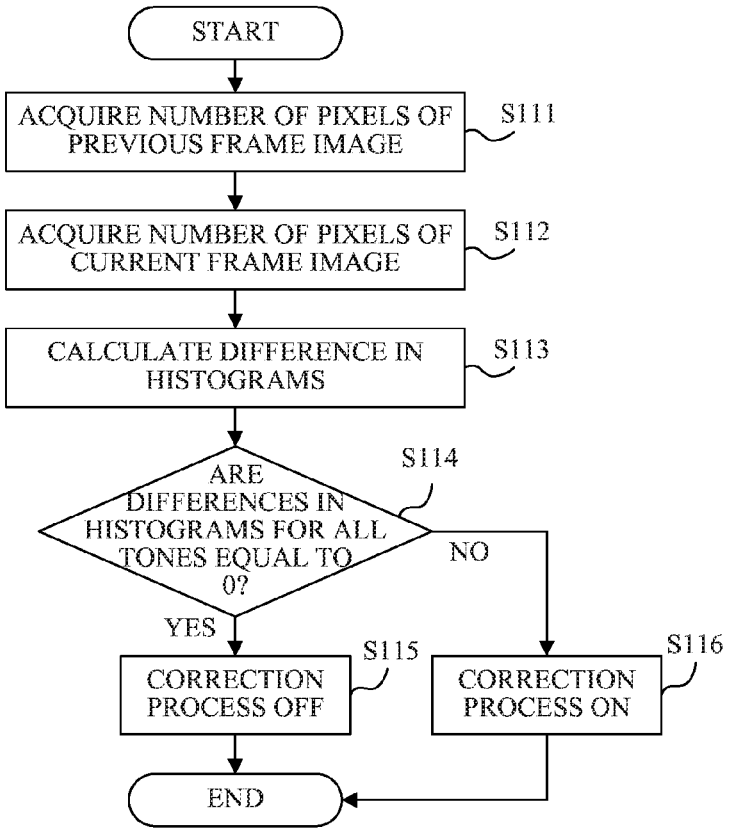
FIG. 8 is a flowchart illustrating an operation of a liquid crystal projector that is Embodiment 2 of the present invention.
Figure 9:
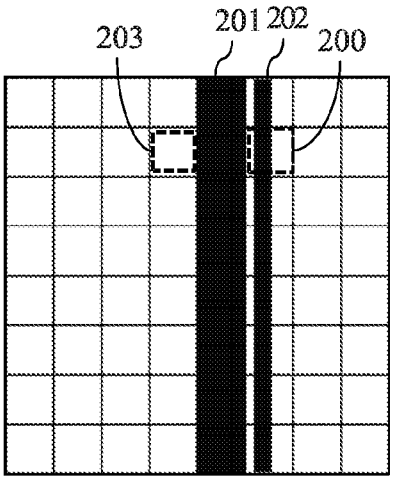
(PRIOR ART) FIG. 9
FIG. 9 illustrates an example of generation of the disclination.
Figure 10A:
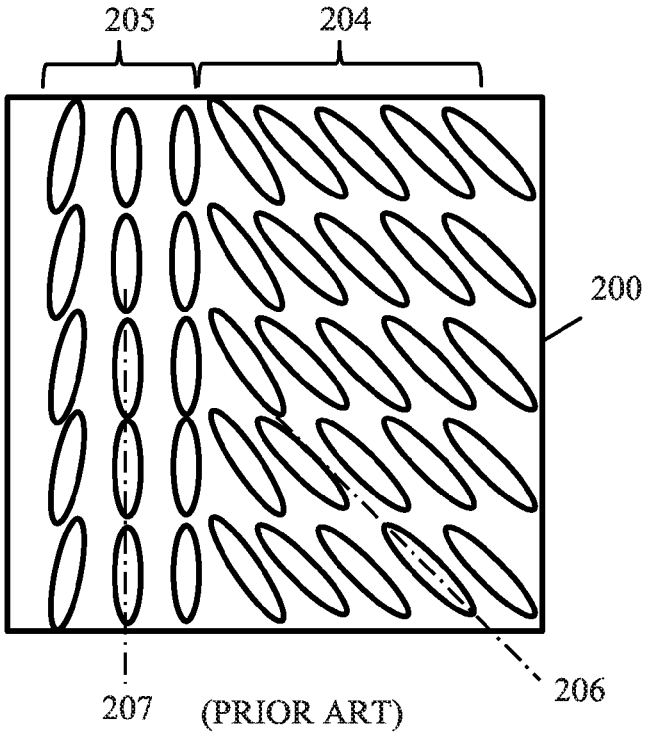
FIGS. 10A and 10B illustrate states of liquid crystal molecules in a pixel in which the disclination is generated and in a pixel in which the disclination is not generated.
Figure 10B:
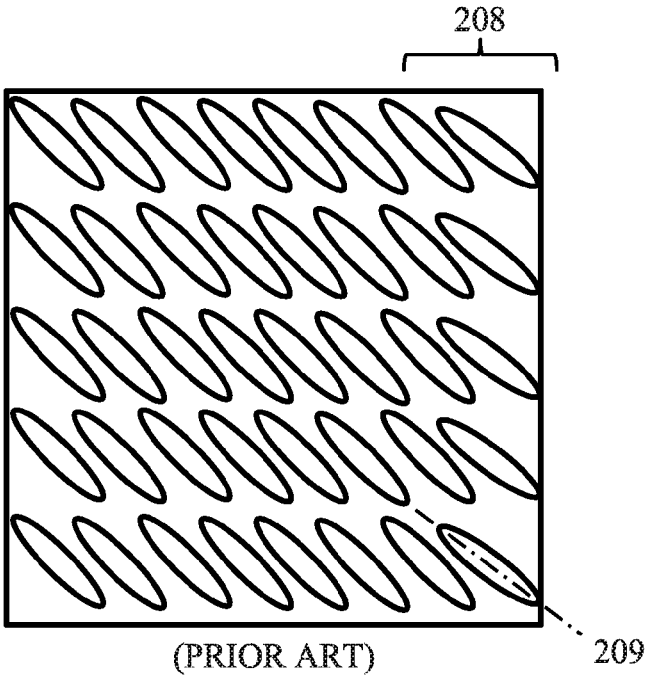

A flowchart of FIG. 8 illustrates a process performed by the image signal generator 510 in this embodiment.

At step S111, the image signal generator 510 extracts, from the previous frame image, the number of the pixels constituting each of the pixel groups each including the mutually identical tone pixels and creates the histogram for the previous frame image. Similarly, at step S112, the image signal generator 510 extracts, from the current frame image, the number of the pixels constituting each of the pixel groups each including the mutually identical tone pixels and creates the histogram for the current frame image. The histogram may be created for whole or part of each frame image.

Next, at step S113, the image signal generator 510 calculates a difference between the histograms for the previous and current frame images created at steps S111 and S112, that is, calculates, for each tone, a difference between the numbers of the pixels of the same tone pixel groups in the previous and current frame images.

Thereafter, at step S114, the image signal generator 510 determines whether or not the differences between the numbers of the pixels of the same tone pixel groups for all of the tones are 0. If the above differences for all of the tones are 0, the image signal generator 510 regards the input image signal as the still image signal and then proceeds to step S115 to make a setting that does not perform the correction process by the correction circuit 503. If at least one of the above differences for all of the tones is 0, the image signal generator 510 regards the input image signal as the moving image signal and then proceeds to step S116 to make a setting that performs the correction process.

This embodiment enables causing the correction circuit 503 to perform the correction process when the input image signal is the moving image signal, that is, when the tailing is highly likely to be generated while preventing the correction process from being performed when the input image signal is the still image signal. This enables suppressing the generation of the tailing when the moving image signal is displayed, without adding the black display pixel (specific pixel), which is unnecessary for the still image signal when the still image signal is displayed.

This embodiment described the case where the image signal generator 510 determines whether the input image signal is the moving image signal or the still image signal by comparing the histograms created for the previous and subsequent frame images. However, the image signal generator 510 may have a function as a motion detector that detects a motion vector between the previous and subsequent frame images. In this case, the correction circuit 503 may perform the correction process only in one of a case where a direction of the detected motion vector is identical (or close) to the oblique movement direction 95 illustrated in FIGS. 6B and 6C in which the tailing is generated or a case where a motion velocity (motion amount) indicated by the motion vector is one pixel per frame. This process enables performing the correction process only on an area in the frame image where the tailing is highly likely to be generated. The detection of the motion vector may be performed by any of various known methods such as a block matching method. The direction and the velocity of the motion vector in and at which the correction process is to be performed may be optimally selected depending on the liquid crystal display element, a drive condition thereof and the like.

Although each of the above embodiments described the image signal generating apparatus (image signal generator 510) built in the liquid crystal projector (liquid crystal display apparatus), the image signal generating apparatus may be configured alternatively as an apparatus separate from the liquid crystal display apparatus such as a personal computer.

Each of the above embodiments enables suppressing, by providing a dark tone (third tone) to the specific pixel located near the corner portion of the first image area, the generation of tailing without decreasing the brightness and the contrast of the displayed image.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-257174, filed on Dec. 19, 2014, which is hereby incorporated by reference wherein in its entirety.

What is claimed is:

1. An image signal generator configured to generate, from an input image signal, an output image signal for image display by a liquid crystal display element, the image signal generator comprising:

a corner detector configured to detect, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image;

a tone provider configured to generate the output image signal by providing a third tone lower than the second tone to one specific pixel adjacent in the oblique direction to a vertex of the corner portion in at least one of the multiple frame images; and a determiner configured to determine whether the input image signal is a moving image signal or a still image signal, wherein the tone provider is configured to provide the third tone to the specific pixel when the input image signal is determined to be the moving image signal.

2. The image signal generator according to claim 1, wherein the tone provider is configured to provide the third tone to the specific pixel in a case where, between a previous frame image and a subsequent frame image among the multiple frame images included in the moving image signal, the corner portion moves in an opposite direction to a convex direction of the corner portion in the previous frame image, the opposite direction being other than the vertical and horizontal directions.

3. The image signal generator according to claim 1, further comprising a motion detector configured to detect a motion of the corner portion between a previous frame image and a subsequent frame image among the multiple frame images included in the moving image signal, wherein the tone provider is configured to provide the third tone to the specific pixel in at least one of a case where a direction of the motion, which is other than the vertical and horizontal directions, is an opposite direction to a convex direction of the corner portion in the previous frame image and a case where an amount of the motion between the previous and subsequent frame images is one pixel per frame.

4. The image signal generator according to claim 1, wherein the corner detector is configured to detect the corner portion including at least two pixels in both the vertical and horizontal directions.

5. An image signal generator configured to generate, from an input image signal, an output image signal for image display by a liquid crystal display element, the image signal generator comprising:

a corner detector configured to detect, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image; and a tone provider configured to generate the output image signal by providing a third tone lower than the second tone to one specific pixel included in a third image area in at least one of the multiple frame images, the third image area being a rectangular area that includes (a) at least three pixels in both the vertical and horizontal directions, (b) a vertex pixel adjacent in the oblique direction to a vertex of the corner portion and (c) other pixels than the vertex pixel which are not adjacent to the first image area.

6. The image signal generator according to claim 5, further comprising a determiner configured to determine whether the input image signal is a moving image signal or a still image signal, wherein the tone provider is configured to provide the third tone to the specific pixel when the input image signal is determined to be the moving image signal.

7. An image signal generator configured to generate an image signal for image display by a liquid crystal display element, the liquid crystal display element having a characteristic that, when displaying multiple frame images which are contained in the image signal and each of which includes (a) a first image area having a first tone and including a corner portion and (b) a second image area having a second tone higher than the first tone and being adjacent in vertical, horizontal and oblique directions to the corner portion, and between a previous frame image and a subsequent frame image among the multiple frame images, a direction of a motion of the corner portion, which is other than the vertical and horizontal directions, is opposite to a convex direction of the corner portion in the previous frame image, in each of first liquid crystal pixels adjacent in vertical and horizontal directions to the corner portion, disclination in which directions of liquid crystal molecules become a specific direction is generated, and in one second liquid crystal pixel adjacent in an oblique direction to a vertex of the corner portion, a state occurs in which directions of liquid crystal molecules are unfixed, the image single generator comprising:

a tone provider configured to generate the image signal by providing a third tone lower than the second tone to a pixel that is included in at least one of the multiple frame images and corresponds to the second liquid crystal pixel; and an image outputter configured to output the generated image signal.

8. A liquid crystal display apparatus comprising:

a liquid crystal display element;

an image signal generator configured to generate, from an input image signal, an output image signal for image display by the liquid crystal display element; and a driver configured to drive the liquid crystal display element depending on the output image signal, wherein the image signal generator comprises:

a corner detector configured to detect, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image;

a tone provider configured to generate the output image signal by providing a third tone lower than the second tone to one specific pixel adjacent in the oblique direction to a vertex of the corner portion in at least one of the multiple frame images; and a determiner configured to determine whether the input image signal is a moving image signal or a still image signal, wherein the tone provider is configured to provide the third tone to the specific pixel when the input image signal is determined to be the moving image signal.

9. A liquid crystal display apparatus comprising:

a liquid crystal display element;

an image signal generator configured to generate, from an input image signal, an output image signal for image display by the liquid crystal display element; and a driver configured to drive the liquid crystal display element depending on the output image signal, wherein the image signal generator comprises:

a corner detector configured to detect, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image; and a tone provider configured to generate the output image signal by providing a third tone lower than the second tone to one specific pixel included in a third image area in at least one of the multiple frame images, the third image area being a rectangular area that includes (a) at least three pixels in both the vertical and horizontal directions, (b) a vertex pixel adjacent in the oblique direction to a vertex of the corner portion and (c) other pixels than the vertex pixel which are not adjacent to the first image area.

10. A liquid crystal display apparatus comprising:

a liquid crystal display element;

an image signal generator configured to generate, from an input image signal, an output image signal for image display by the liquid crystal display element; and a driver configured to drive the liquid crystal display element depending on the output image signal, wherein the liquid crystal display element has a characteristic that, when displaying multiple frame images which are contained in the image signal and each of which includes (a) a first image area having a first tone and including a corner portion and (b) a second image area having a second tone higher than the first tone and being adjacent in vertical, horizontal and oblique directions to the corner portion, and between a previous frame image and a subsequent frame image among the multiple frame images, a direction of a motion of the corner portion, which is other than the vertical and horizontal directions, is opposite to a convex direction of the corner portion in the previous frame image, in each of first liquid crystal pixels adjacent in vertical and horizontal directions to the corner portion, disclination in which directions of liquid crystal molecules become a specific direction is generated, and in one second liquid crystal pixel adjacent in an oblique direction to a vertex of the corner portion, a state occurs in which directions of liquid crystal molecules are unfixed, wherein the image signal generator comprises:

a tone provider configured to generate the image signal by providing a third tone lower than the second tone to a pixel that is included in at least one of the multiple frame images and corresponds to the second liquid crystal pixel; and an image outputter configured to output the generated image signal.

11. A method of generating, from an input image signal, an output image signal for image display by a liquid crystal display element, the method comprising:

detecting, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image;

generating the output image signal by providing a third tone lower than the second tone to one specific pixel adjacent in the oblique direction to a vertex of the corner portion in at least one of the multiple frame images; and determining whether the input image signal is a moving image signal or a still image signal, wherein the method provides the third tone to the specific pixel when determining that the input image signal is the moving image signal.

12. A method of generating, from an input image signal, an output image signal for image display by a liquid crystal display element, the method comprising:

detecting, when the input image signal contains multiple frame images each of which includes (a) a first image area having a first tone and including a corner portion and (b) a second image area having a second tone higher than the first tone and being adjacent in vertical, horizontal and oblique directions to the corner portion, the corner portion in each frame image; and generating the output image signal by providing a third tone lower than the second tone to one specific pixel included in a third image area in at least one of the multiple frame images, the third image area being a rectangular area that includes (a) at least three pixels in both the vertical and horizontal directions, (b) a vertex pixel adjacent in the oblique direction to a vertex of the corner portion and (c) other pixels than the vertex pixel which are not adjacent to the first image area.

13. A method of generating an image signal for image display by a liquid crystal display element, the liquid crystal display element having a characteristic that, when displaying multiple frame images which are contained in the image signal and each of which includes (a) a first image area having a first tone and including a corner portion and (b) a second image area having a second tone higher than the first tone and being adjacent in vertical, horizontal and oblique directions to the corner portion, and between a previous frame image and a subsequent frame image among the multiple frame images, a direction of a motion of the corner portion, which is other than the vertical and horizontal directions, is opposite to a convex direction of the corner portion in the previous frame image, in each of first liquid crystal pixels adjacent in vertical and horizontal directions to the corner portion, disclination in which directions of liquid crystal molecules become a specific direction is generated, and in one second liquid crystal pixel adjacent in an oblique direction to a vertex of the corner portion, a state occurs in which directions of liquid crystal molecules are unfixed, the method comprising:

generating the image signal by providing a third tone lower than the second tone to a pixel that is included in at least one of the multiple frame images and corresponds to the second liquid crystal pixel; and outputting the generated image signal.

* * * * *